US012434940B2

(12) United States Patent
Taguchi et al.

(10) Patent No.: US 12,434,940 B2
(45) Date of Patent: Oct. 7, 2025

(54) PRINTING APPARATUS

(71) Applicant: CANON KABUSHIKI KAISHA, Tokyo (JP)

(72) Inventors: Motoyuki Taguchi, Tokyo (JP); Masaaki Matsuura, Kanagawa (JP); Noriyuki Sugiyama, Kanagawa (JP); Junichi Kubokawa, Nagasaki (JP); Yasunori Matsumoto, Kanagawa (JP); Yumi Mukoyama, Tokyo (JP); Takahiro Kiuchi, Tokyo (JP); Kyosuke Kamishima, Kanagawa (JP); Haruo Uchida, Tokyo (JP); Keisei Hakamata, Kanagawa (JP); Takaaki Ishida, Kanagawa (JP); Shoichi Kan, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 18/313,851

(22) Filed: May 8, 2023

(65) Prior Publication Data

US 2023/0382673 A1 Nov. 30, 2023

(30) Foreign Application Priority Data

May 27, 2022 (JP) ..... 2022-087099

(51) Int. Cl.
*B65H 85/00* (2006.01)
*B65H 3/44* (2006.01)
(Continued)

(52) U.S. Cl.
CPC ..... *B65H 85/00* (2013.01); *B65H 3/44* (2013.01); *B65H 5/26* (2013.01); *B65H 29/60* (2013.01);
(Continued)

(58) Field of Classification Search
CPC . B65H 3/44; B65H 5/26; B65H 29/58; B65H 29/60; B65H 85/00;
(Continued)

(56) References Cited

U.S. PATENT DOCUMENTS

2018/0052415 A1* 2/2018 Shiokawa ..... B65H 1/266
2018/0088503 A1* 3/2018 Yamauchi ..... B65H 7/20
2019/0020777 A1* 1/2019 Kawakami ..... B41J 3/60

FOREIGN PATENT DOCUMENTS

JP 2003201069 A * 7/2003
JP 2006330250 A * 12/2006
(Continued)

*Primary Examiner* — Prasad V Gokhale
(74) *Attorney, Agent, or Firm* — Canon U.S.A., Inc. IP Division

(57) ABSTRACT

A printing apparatus includes a printing unit, and first, second, and third conveyance paths. The printing unit performs printing at a printing position on a print medium conveyed in a conveyance direction. The first conveyance path causes the print medium to pass through the printing position of the printing unit. The second conveyance path reverses obverse and reverse surfaces of the print medium, and the third conveyance path reverses obverse and reverse surfaces of the print medium. The second conveyance path branches from the first conveyance path at a first branching point on a downstream side of the printing position in the conveyance direction and merges into the first conveyance path on an upstream side of the printing position. The third conveyance path branches from a second branching point on the second conveyance path and merges into the first conveyance path on the upstream side of the printing position.

12 Claims, 12 Drawing Sheets

(51) Int. Cl.
*B65H 5/26* (2006.01)
*B65H 29/60* (2006.01)

(52) U.S. Cl.
CPC .... *B65H 2405/332* (2013.01); *B65H 2511/11* (2013.01); *B65H 2511/414* (2013.01); *B65H 2513/42* (2013.01)

(58) Field of Classification Search
CPC ..... B65H 2405/332; B65H 2511/11; B65H 2511/414; B65H 2513/42
See application file for complete search history.

(56) References Cited

FOREIGN PATENT DOCUMENTS

| | | | |
|---|---|---|---|
| JP | 2010-275085 | A | 12/2010 |
| JP | 2020-015180 | A | 1/2020 |

* cited by examiner

FIG. 5

| OPERATION MODE OF SWITCHING UNIT 70 | FLAPPER 71 | FLAPPER 73 | OPERATION OF PRINTING APPARATUS AT MODE SELECTION |
|---|---|---|---|
| FIRST MODE | FIRST POSITION | THIRD POSITION | INITIAL STATE, WHEN DISCHARGING PRINT MEDIUM PL, WHEN PRINTING FIRST SURFACE |
| SECOND MODE | SECOND POSITION | THIRD POSITION | WHEN PERFORMING REVERSING CONVEYANCE OF PRINT MEDIUM PL |
| THIRD MODE | SECOND POSITION | FOURTH POSITION | WHEN PERFORMING REVERSING CONVEYANCE OF PRINT MEDIUM PS |
| FOURTH MODE | FIRST POSITION | FOURTH POSITION | WHEN DISCHARGING OF PRINT MEDIUM PS, WHEN PRINTING FIRST SURFACE |

FIG. 11

| OPERATION MODE OF SWITCHING UNIT 70 | FLAPPER 71 | FLAPPER 73 | OPERATION OF PRINTING APPARATUS AT MODE SELECTION |
|---|---|---|---|
| FIRST MODE | FIRST POSITION | THIRD POSITION | INITIAL STATE, WHEN PRINTING FIRST SURFACE OF PRINT MEDIUM PL |
| SECOND MODE | SECOND POSITION | THIRD POSITION | WHEN PERFORMING REVERSING CONVEYANCE OF PRINT MEDIUM PL, WHEN DISCHARGING |
| THIRD MODE | SECOND POSITION | FOURTH POSITION | WHEN PERFORMING REVERSING CONVEYANCE OF PRINT MEDIUM PS, WHEN DISCHARGING |
| FOURTH MODE | FIRST POSITION | FIFTH POSITION | WHEN RECORDING FIRST SURFACE OF PRINT MEDIUM PS |

PRINTING APPARATUS

BACKGROUND

Field

The present disclosure relates to a printing apparatus.

Description of the Related Art

There is known a printing apparatus capable of printing both surfaces of a print medium. In such a printing apparatus, a conveyance path configured to reverse the obverse and reverse surfaces of a print medium with one surface printed is sometimes provided (for example, Japanese Patent Laid-Open No. 2020-15180 and Japanese Patent Laid-Open No. 2010-275085).

As a method of efficiently performing double-sided printing, it is considered that when a print medium with its obverse surface already printed is passing through a conveyance path configured to reverse the obverse and reverse surfaces (or staying in the conveyance path), printing for the obverse surface of a following print medium is performed. To more efficiently perform double-sided printing, it is preferable to more appropriately perform this operation for various print media having different lengths in the conveyance direction.

SUMMARY

The present disclosure provides a technique for more efficiently performing double-sided printing for print media having different lengths in the conveyance direction. According to an aspect of the present disclosure, a printing apparatus includes a printing unit configured to perform printing at a printing position on a print medium conveyed in a conveyance direction, a first conveyance path configured to cause the print medium to pass through the printing position of the printing unit, a second conveyance path configured to reverse obverse and reverse surfaces of the print medium, and a third conveyance path configured to reverse obverse and reverse surfaces of the print medium, wherein the second conveyance path branches from the first conveyance path at a first branching point on a downstream side of the printing position in the conveyance direction and merges into the first conveyance path on an upstream side of the printing position, and wherein the third conveyance path branches from a second branching point on the second conveyance path and merges into the first conveyance path on the upstream side of the printing position.

Further features of the present disclosure will become apparent from the following description of exemplary embodiments (with reference to the attached drawings).

BRIEF DESCRIPTION OF THE DRAWINGS

FIG. 5 is a view for explaining the operation modes of a switching unit in a printing operation;

FIG. 11 is a view for explaining the operation modes of a switching unit in a printing operation.

DESCRIPTION OF THE EMBODIMENTS

Figure 1A:
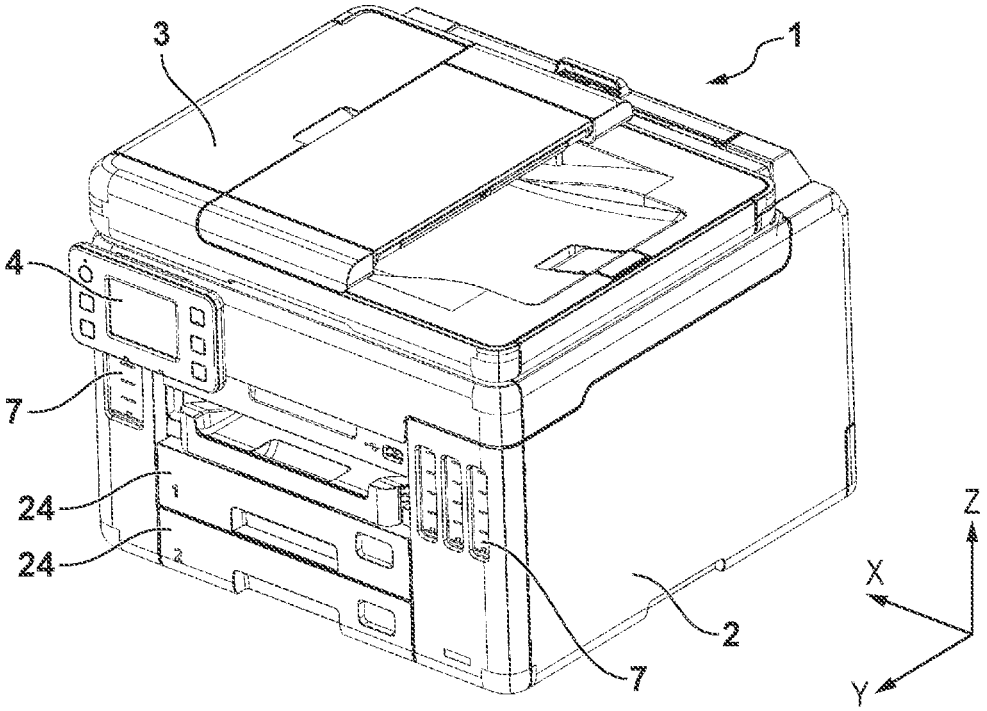
FIG. 1A is a view showing the outer appearance of a printing apparatus according to an embodiment.

Hereinafter, embodiments will be described in detail with reference to the attached drawings. Note, the following embodiments are not intended to limit the scope of the terms in the claims. Multiple features are described in the embodiments, but limitation is not made that requires all such features, and multiple such features may be combined as appropriate. Furthermore, in the attached drawings, the same reference numerals are given to the same or similar configurations, and redundant description thereof is omitted.

Note that "printing" is not limited to forming significant information such as characters and graphics, and the information can be either significant or insignificant. Also, "printing" represents, in a broad sense, forming images, figures, patterns, and the like on print media, or processing print media, regardless of whether the information is visualized so that a human can visually perceive it.

Also, "print media" not only represents paper used in general printing apparatuses, but also a wide range of materials capable of accepting printing materials, including cloth, plastic film, metal plates, glass, ceramics, wood, leather, and the like.

Arrows X, Y, and Z in the drawings indicate the widthwise direction, the depth direction, and the height direction of a printing apparatus 1, respectively, and these directions cross each other (here, orthogonal to each other).

First Embodiment

<Outline of Printing Apparatus>

FIG. 1A is a view showing the outer appearance of a printing apparatus 1 according to an embodiment of the present invention. The printing apparatus 1 according to this embodiment is a serial type inkjet printing apparatus that discharges ink supplied from ink tanks 7 to a print medium P and prints an image. However, a full-line type inkjet printing apparatus or a printing apparatus using another method such as an electrophotographic method can also be employed as the printing apparatus 1.

The printing apparatus 1 has a substantially rectangular parallelepiped shape as a whole. On the upper side of a main body 2, a reading device 3 capable of reading an original is provided such that it can freely be opened/closed with respect to the main body 2. A touch panel type display device 4 that accepts an operation of a user is provided on the front surface of the main body 2. In addition, a paper feed cassette 24 capable of stacking and storing a print medium P is provided on the front surface of the main body 2. The user can replenish the print medium P to the printing apparatus 1 by drawing the paper feed cassette 24.

Figure 1B:
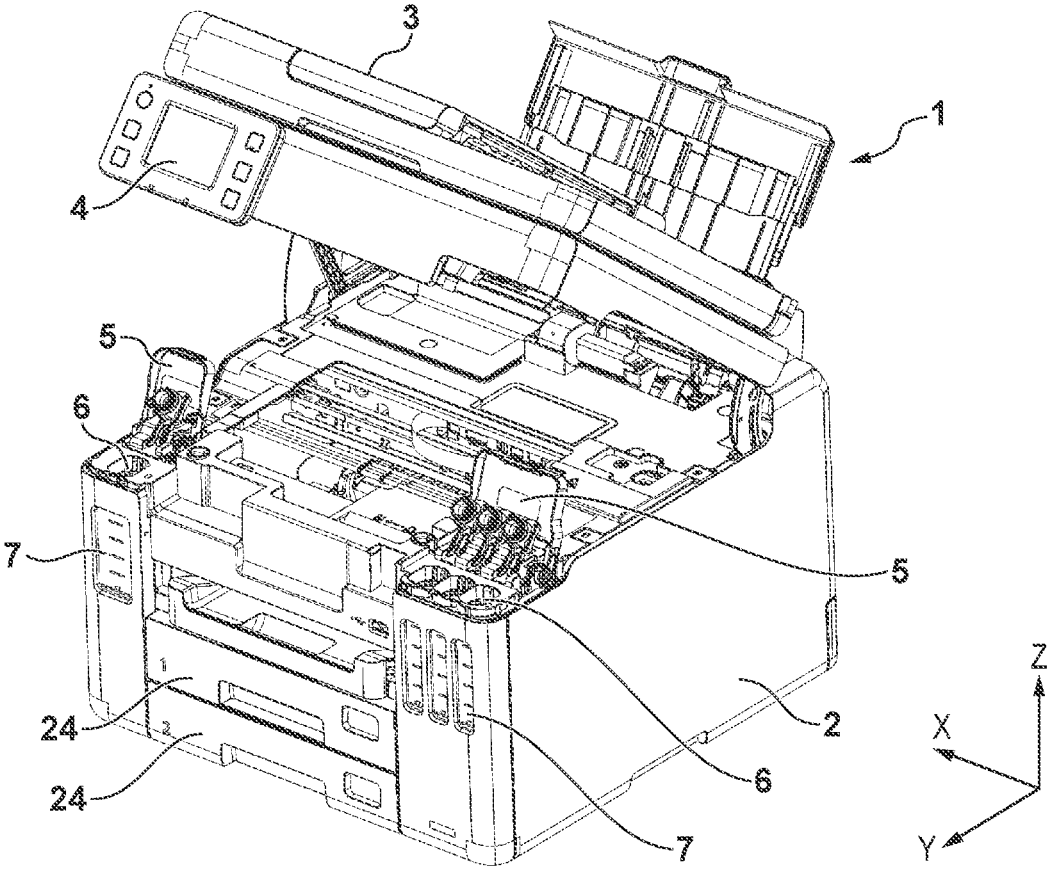
FIG. 1B is a view showing the printing apparatus in a state in which a reading device and an ink tank cover are open.

FIG. 1B is a view showing the printing apparatus 1 in a state in which the reading device 3 and ink tank covers 5 are open. In FIG. 1B, ink injection ports 6 configured to inject ink are exposed on the front surface of the printing apparatus 1. That is, when the reading device 3 and the ink tank covers 5 are opened, ink can be replenished to the ink tanks 7 via the ink injection ports 6.

<Internal Configuration of Printing Apparatus>

Figure 2A:
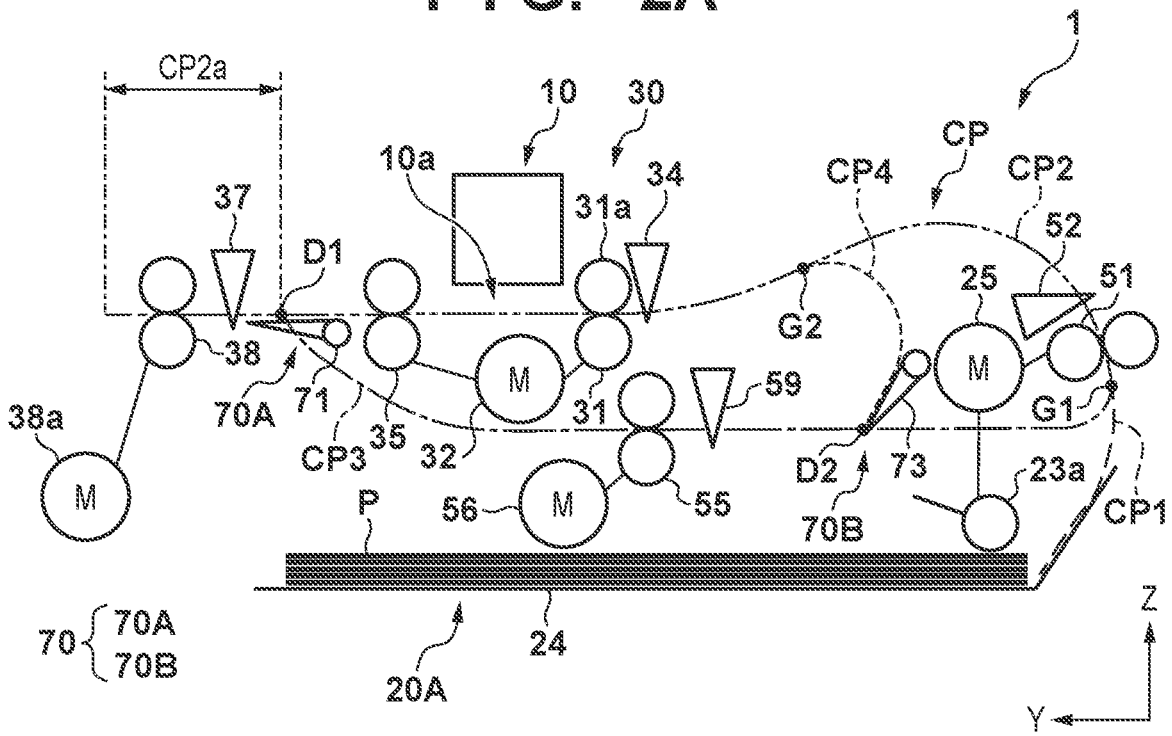
FIG. 2A is a schematic view for explaining the internal configuration of the printing apparatus.
Figure 2B:
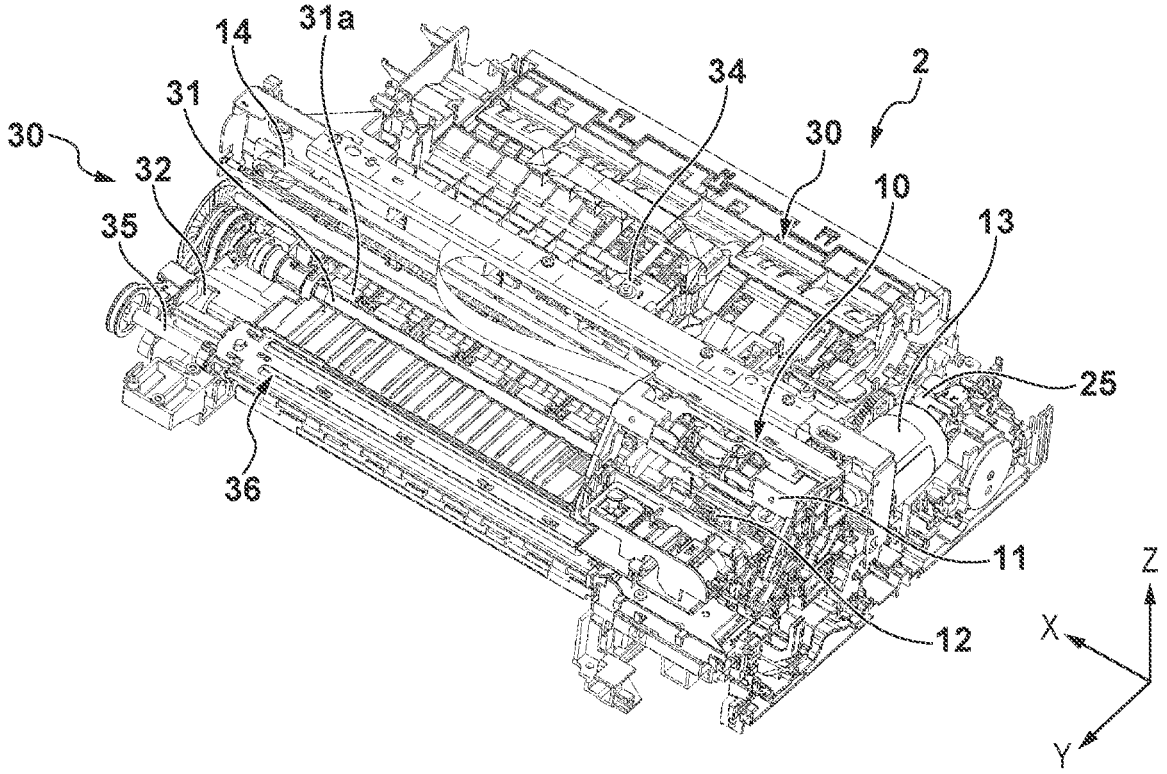
FIG. 2B is a perspective view showing parts of a printing unit and a conveyance unit.

FIG. 2A is a schematic view for explaining the internal configuration of the printing apparatus 1. The printing apparatus 1 includes a sheet stacking unit a conveyance unit 30, and a printing unit 10. Also, a conveyance path CP is formed inside the printing apparatus 1. FIG. 2B is a perspective view showing parts of the printing unit 10 and the conveyance unit 30. The conveyance direction of the print medium P will sometimes be referred to as a sub-scanning direction, the conveyance source as an upstream side, and the conveyance destination as a downstream side hereinafter. In this embodiment, the sub-scanning direction is the Y direction in a planar view of the printing apparatus 1.

(Conveyance Path)

The conveyance path CP is a path to convey the print medium P. The conveyance path CP is formed by guide members that guide the conveyance of the print medium P, the wall portions of a housing forming the main body 2, flappers 71 and 73 of a switching unit 70 to be described later, and the like. The conveyance path CP according to this embodiment is configured to include a plurality of branching points. In this embodiment, the conveyance path CP includes a branching point D1 and a branching point D2. Also, the conveyance path CP includes a merging point G1 and a merging point G2 each of which is a merging point where the path branching from a branching point merges into another path.

The conveyance path CP includes a paper feed path CP1, a main path CP2, a reversing path CP3, and a branching path CP4.

The paper feed path CP1 is a path to feed the print medium P from the sheet stacking unit 20A. The paper feed path CP1 is connected to the sheet stacking unit 20A at an upstream side end and connected to the main path CP2 at a downstream side end.

The main path CP2 is a path to cause the print medium P to pass through a printing position 10*a* by the printing unit 10. The main path CP2 is connected to the paper feed path CP1 at an upstream side end, and its downstream side end is connected to the discharge portion of the print medium P. Hence, for example, when performing single-sided printing on the print medium P, the print medium P passes through the paper feed path CP1 and the main path CP2 and is then discharged from the printing apparatus 1. Here, a portion of the main path CP2 on the downstream side of the branching point D1 is a region used for an operation of discharging the print medium P and reversing its obverse and reverse surfaces and will sometimes be referred to as a reversing/discharge region CP2*a* hereinafter.

The reversing path CP3 is a path to reverse the obverse and reverse surfaces of the print medium P. One end of the reversing path CP3 is the branching point D1 on the main path CP2, and the other end is the merging point G1 on the main path CP2. As will be described later in detail, when reversing the obverse and reverse surfaces of the print medium P, the advancing direction of the print medium P is made reverse to that when performing printing by the printing unit 10, and the print medium P is made to enter the reversing path CP3.

The branching path CP4 is a path to reverse the obverse and reverse surfaces of the print medium P, and is a path branching from the reversing path CP3. One end of the branching path CP4 is the branching point D2 on the reversing path CP3 (on the conveyance path), and the other end is the merging point G2 provided on the upstream side of the printing position 10*a* on the main path CP2. As will be described later in detail, when the branching path CP4 is provided, a path for reversing the print medium P, whose path length is different from that of the reversing path CP3, is formed. This can more appropriately execute the double-sided printing operation for print media having different lengths in the conveyance direction. Note that which paths the print medium P follows when the obverse and reverse surfaces of the print medium P are reversed in the double-sided printing operation or the like will be described later.

(Switching Unit)

The switching unit 70 switches the entry destination of the print medium P at a branching point on the conveyance path CP. The switching unit 70 includes a conveyance path switching unit 70A that switches the entry destination of the print medium P at the branching point D1, and a conveyance path switching unit 70B that switches the entry destination of the print medium P at the branching point D2.

The conveyance path switching unit 70A includes the flapper 71 and a driving source that drives it. The flapper 71 is provided to be displaceable between a "first position" and a "second position" by the driving source at the branching point D1 between a discharge roller 35 and a sensor 37. The "first position" is a position to convey the print medium P along the main path CP2 (see FIG. 3A), and the "second position" is a position to make the print medium P enter from the main path CP2 to the reversing path CP3 (see FIG. 3B). In other words, the "first position" is a position at which the print medium can pass through the branching point D1 along the main path CP2, and the "second position" is a position at which the print medium can enter from the branching point D1 to the reversing path CP3. The flapper 71 is an example of a switching member that is provided between the printing position 10*a* by the printing unit 10 and a reversing roller 38 and can switch, at the branching point D1, the entry destination of the print medium P conveyed by the reversing roller 38 in a direction reverse to the advancing direction at the time of printing from the main path CP2 to the reversing path CP3. Note that as the driving source that drives the flapper 71, a driving source 38*a* that drives the reversing roller 38 may be used, or a driving source (a motor, a solenoid, or the like) different from the driving source 38*a* may be used.

The conveyance path switching unit 70B includes the flapper 73 and a driving source such as a motor that drives it. The flapper 73 is provided to be displaceable between a "third position" and a "fourth position" by the driving source. The "third position" is a position to convey the print medium P along the reversing path CP3 (see FIG. 4A), and the "fourth position" is a position to make the print medium P enter from the reversing path CP3 to the branching path CP4 (see FIG. 4B). The flapper 73 is an example of a switching member that can switch, at the branching point D2, the entry destination of the print medium P from the reversing path CP3 to the branching path CP4.

(Sheet Stacking Unit)

The sheet stacking unit 20A stacks the print medium P (for example, a paper sheet) and feeds the stacked print medium P to the conveyance path CP. In this embodiment, the sheet stacking unit 20A includes the paper feed cassette 24 that stacks the print medium P, and a paper feed roller 23*a* that feeds the print medium P stacked in the paper feed cassette 24.

The paper feed cassette 24 is provided to be detachable from the front portion of the main body 2 of the printing apparatus 1. The paper feed roller 23*a* is provided extending in the X direction, and is rotated by the driving force of a driving source 25 such as a motor to feed the print medium P. By the paper feed roller 23*a*, the print medium P is fed to the main path CP2 via the paper feed path CP1. Here, the paper feed path CP1 indicates the path from the sheet stacking unit 20A to an intermediate roller 51 to be described later.

(Conveyance Unit)

The conveyance unit 30 conveys the print medium P along the conveyance path CP. The conveyance unit 30 includes a plurality of conveyance rollers, more specifically, the intermediate roller 51, a main conveyance roller 31, the discharge roller 35, the reversing roller 38, and an intermediate roller 55.

The intermediate roller 51 conveys the print medium P conveyed on the paper feed path CP1 by the paper feed roller 23*a* to the main path CP2 on the downstream side. The intermediate roller 51 is driven by the driving source 25 common to the paper feed roller 23*a*. Note that to stop driving of the paper feed roller 23*a* and drive only the intermediate roller 51, driving on the side of the paper feed roller 23*a* is disconnected using a clutch or the like. The intermediate roller 51 may be driven by a driving source different from the driving source 25 of the paper feed roller 23*a*.

The main conveyance roller 31 conveys the print medium P conveyed on the main path CP2 by the intermediate roller 51 further to the downstream side. The main conveyance roller 31 is provided extending in the X direction and is driven by a driving source 32 such as a motor. A driven roller 31*a* is pressed against the main conveyance roller 31, and the print medium P is conveyed while being sandwiched in a nip portion formed by the main conveyance roller 31 and the driven roller 31*a*.

The discharge roller 35 conveys the print medium P conveyed on the main path CP2 by the main conveyance roller 31 further to the downstream side. The discharge roller 35 is provided extending in the X direction and is driven by the driving source 32 common to the main conveyance roller 31.

The reversing roller 38 can convey the print medium P conveyed on the main path CP2 by the discharge roller 35 further to the downstream side and discharge it from the printing apparatus 1. The reversing roller 38 is provided on the downstream side of the branching point D1 on the main path CP2 and can convey the print medium P conveyed on the main path CP2 while reversing the advancing direction. Thus, the print medium enters the reversing path CP3. The reversing roller 38 is driven by the driving source 38*a* such as a motor so as to be rotatable in the forward direction and the reverse direction.

In this embodiment, the reversing roller 38 rotates in the CCW direction (counterclockwise direction, see FIG. 3A) when discharging the print medium P, and rotates in the CW direction (clockwise direction) when making the print medium P enter the reversing path CP3. Note that as will be described later, to make the print medium P enter the reversing path CP3 by the reversing roller 38, the flapper 71 of the switching unit 70 is moved to the "second position".

The intermediate roller 55 conveys the print medium P conveyed from the main path CP2 to the reversing path CP3 by the reversing roller 38 further to the downstream side of the reversing path CP3. The intermediate roller 55 is provided extending in the X direction and is driven by a driving source 56 such as a motor. In this embodiment, the branching point D2 is provided on the reversing path CP3 on the downstream side of the intermediate roller 55. Hence, according to the position of the flapper 73 to be described later, the print medium P conveyed by the intermediate roller 55 directly passes through the reversing path CP3 and is reconveyed to the main path CP2, or is reconveyed from the branching point D2 to the main path CP2 via the branching path CP4.

Also, in this embodiment, a plurality of sensors configured to detect the leading edge and the trailing edge of the print medium P are provided on the conveyance path CP, and the position of the print medium P on the conveyance path CP can thus be grasped. For example, when a sensor 52 provided on the downstream side of the intermediate roller 51 in the conveyance direction detects the leading edge of the print medium P, a CPU 101 of a control circuit 100 to be described later can determine that the print medium P reaches the intermediate roller 51. Also, when the sensor 52 detects the trailing edge of the print medium P, the CPU 101 can determine that the whole print medium P has passed through the intermediate roller 51. As the sensor 52, a known technique can appropriately be used. For example, the sensor 52 may be a lever type photosensor whose lever comes into contact with the print medium P and thus rotates to shield the optical axis from light, or may be a photosensor that directly detects the print medium P. Note that a sensor 34, the sensor 37, and a sensor 59 can have a similar configuration to the sensor 52.

(Printing Unit)

The printing unit 10 includes a printhead 12 that performs printing by discharging ink to the print medium P, and a carriage 11 that reciprocally moves in a predetermined direction with the printhead 12 mounted thereon. In this embodiment, the carriage 11 moves in the X direction. The printing unit 10 includes, as a moving mechanism configured to move the carriage 11, a transmission mechanism configured to include a guide rail that guides the movement of the carriage 11 in the main scanning direction, and a belt 14 that transmits the driving force from a driving source 13 such as a motor to the carriage 11. The movement of the carriage 11 will sometimes be referred to as scanning, and printing an image by the printhead 12 while moving the carriage 11 as print scanning hereinafter.

Printing of an image on the print medium P by the printing apparatus 1 can be performed, for example, in the following way. The print medium P fed from the sheet stacking unit 20A is intermittently conveyed by the conveyance unit 30, and the conveyance of the print medium P and image printing by the printing unit 10 are alternately performed. More specifically, the print medium P is conveyed by the conveyance unit 30 to a row position (a position in the sub-scanning direction) where an image is to be formed and stopped. During the stop of conveyance of the print medium P, print scanning is performed by moving the carriage 11. Next, the print medium P is conveyed by the conveyance unit 30 to the next row position, and a similar process to what is described above is repeated. In this way, an image can be printed on the entire print medium P.

<Double-Sided Printing Operation>

(Outline)

Figure 3A:
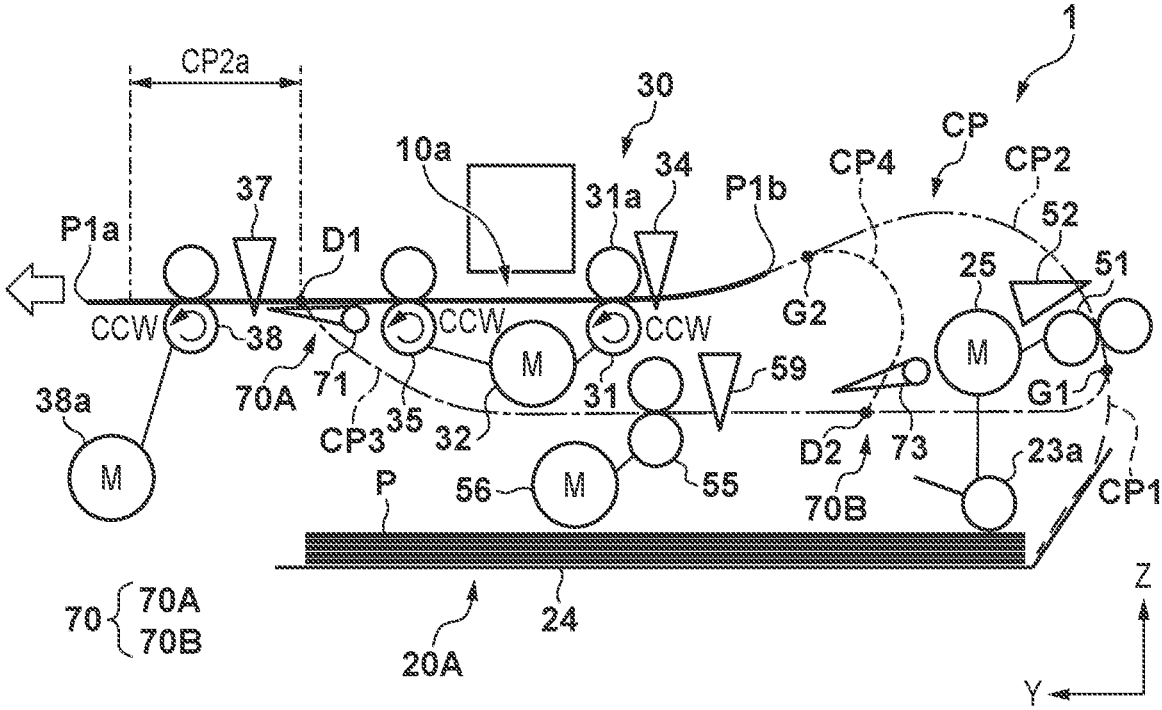
FIG. 3A is a view showing a state in which printing is performed for a print medium by the printing unit.

The double-sided printing operation in the printing apparatus 1 will be described next. FIG. 3A is a view showing a state in which printing is performed for a print medium P1 by the printing unit 10. Here, assume that printing is performed on the obverse surface of the print medium P1. In the following explanation, of the end portions of the print medium P1 in the conveyance direction, an end portion on the front side in the advancing direction during the printing operation will be referred to as an end portion P1*a*, and an end portion on the rear side in the advancing direction during the printing operation will be referred to as an end portion P1*b*.

As shown in FIG. 3A, during printing, the portion of the print medium P1 on the front side in the advancing direction is conveyed to the discharge roller 35 and the reversing roller 38 on the downstream side. When reversing the obverse and reverse surfaces of the print medium P1 after printing on the obverse surface of the print medium P1, first, the print medium P1 is further conveyed by the discharge roller 35 and the reversing roller 38 such that the end portion P1*b* is located on the downstream side of the branching point D1 on the main path CP2.

If the trailing edge (end portion P1*b*) of the print medium P1 is detected by the sensor 37 provided on the downstream side of the branching point D1 on the main path CP2, the rotation direction of the reversing roller 38 is reversed from the CCW direction to the CW direction. Thus, the end portion P1*b* is set to the end portion on the front side in the advancing direction, and the print medium P1 is conveyed in the direction reverse to that in printing. Also, the CPU 101 moves the flapper 71 from the "first position" to the "second position" based on detection of the trailing edge (end portion P1*b*) of the print medium P1 by the sensor 37.

Figure 3B:
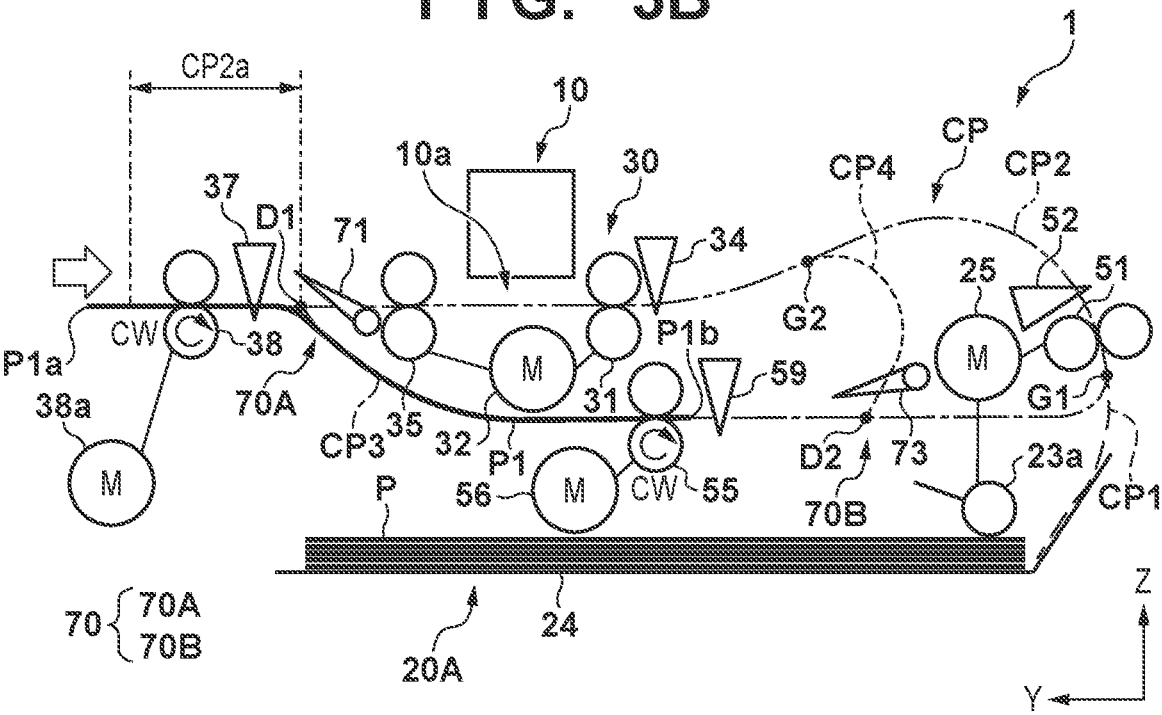
FIG. 3B is a view showing a state in which the print medium enters a reversing path.

By the flapper 71 moved to the "second position", the print medium P1 conveyed with the end portion P1*b* set to the front end is guided, at the branching point D1, from the main path CP2 to the reversing path CP3. FIG. 3B is a view showing a state in which the print medium P1 enters the reversing path CP3. The print medium P1 that has entered the reversing path CP3 is conveyed by the intermediate roller 55 further to the downstream side of the reversing path CP3. Note that as will be described later in detail, here, the flapper 73 is located at the "third position".

The print medium P1 guided to the reversing path CP3 by the reversing roller 38 is conveyed to the intermediate roller 55. If the sensor 59 located on the downstream side of the intermediate roller 55 detects that the print medium P1 is drawn to the reversing path CP3, the CPU 101 to be described later manages the position of the print medium P1 in the reversing path CP3 based on the detection result. The CPU 101 then drives the intermediate roller 55 at a predetermined timing to convey the print medium P1 from the merging point G1 on the upstream side of the intermediate roller 51 to the main path CP2. In the print medium P1 reconveyed to the main path CP2, the front end in the advancing direction is the end portion P1*b*. For this reason, the obverse and reverse surfaces are reversed from those in printing on the obverse surface. Hence, when the print medium P1 is further conveyed along the main path CP2 up to the printing position 10*a* of the printing unit 10, printing on the reverse surface of the print medium P1 is performed. Note that as will be described later in detail, the predetermined timing of conveying the print medium P1 from the merging point G1 to the main path CP2 is, for example, after printing on the first surface of a subsequent print medium P2 is ended or after the subsequent print medium P2 passes through the merging point G1 for printing on the first surface.

After printing on the reverse surface of the print medium P1, the print medium P1 can be discharged from the main path CP2 to the outside of the printing apparatus 1 by continuously rotating the reversing roller 38 in the forward direction without rotating it in the reverse direction. In this way, double-sided printing for the print medium P1 is performed.

<Conveyance Path in Reversing Operation>

The conveyance path when reversing the print medium P will be described next with reference to FIGS. 4A and 4B. In the printing apparatus 1, a setting is sometimes done such that double-sided printing can be performed for a plurality of types of print media having different lengths in the conveyance direction, for example, plain paper of the A4 size and plain paper of the A5 size. From the viewpoint of improving the efficiency of double-sided printing, a double-sided printing operation according to the length of the print medium in the conveyance direction, particularly, a reversing operation of the print medium is preferably performed. Hence, the printing apparatus 1 according to this embodiment is configured to switch the conveyance path of the print medium P when performing the reversing operation of the print medium P. More specifically, the printing apparatus 1 is configured to switch the conveyance path of the print medium P in the reversing operation by the conveyance path switching unit 70B.

Figure 4A:
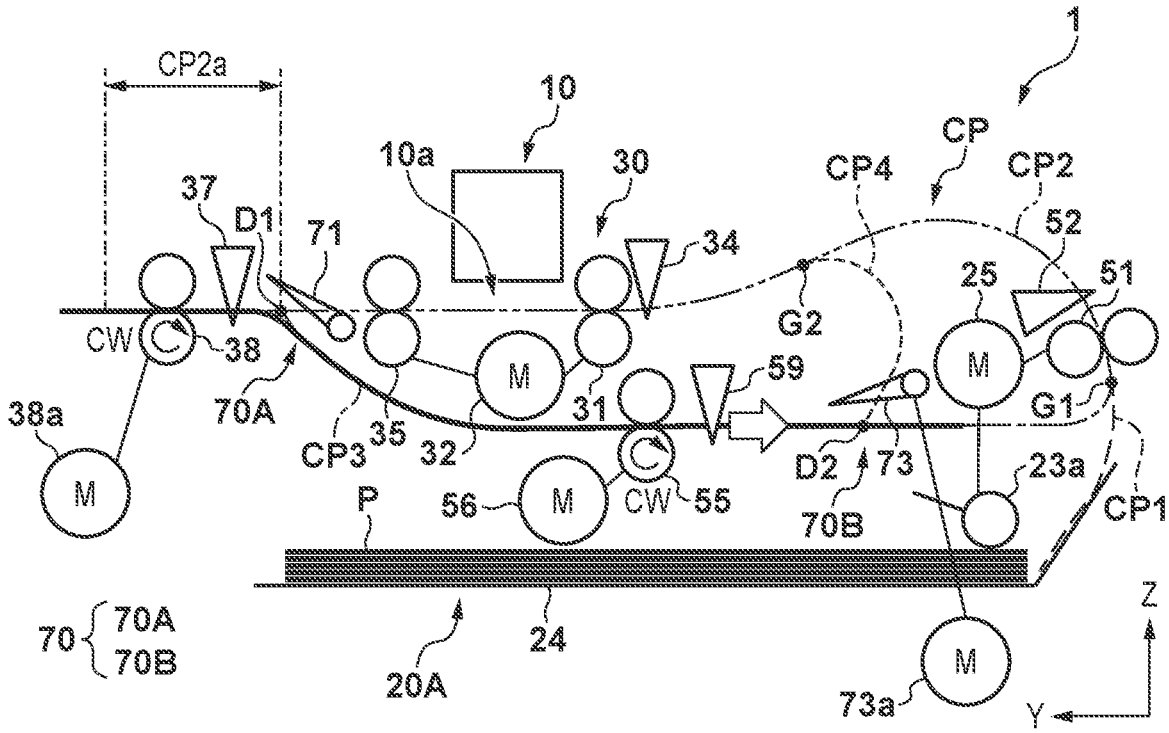
FIG. 4A is a view showing a case where the print medium passes through the reversing path and is reconveyed to a main path.

FIG. 4A shows a case where the print medium P1 passes through the reversing path CP3 and is reconveyed to the main path CP2 at the merging point G1 (see FIG. 3A). At this time, the flapper 73 of the conveyance path switching unit 70B is located at the "third position". Thus, at the branching point D2, the print medium P1 moves straight along the reversing path CP3 without entering the branching path CP4.

Figure 4B:
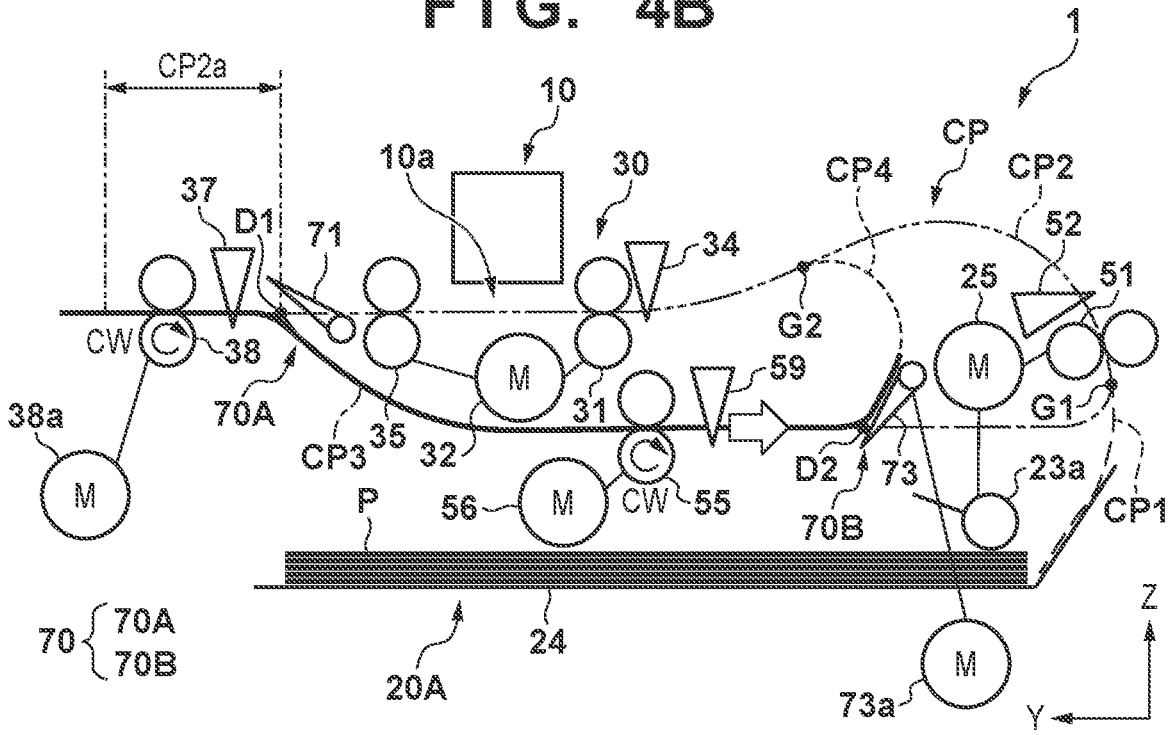
FIG. 4B is a view showing a case where the print medium passes from the reversing path through a branching path and is reconveyed to the main path.

FIG. 4B shows a case where the print medium P1 passes from the reversing path CP3 through the branching path CP4 and is reconveyed to the main path CP2 at the merging point G2. At this time, the flapper 73 of the conveyance path switching unit 70B is located at the "fourth position". Thus, at the branching point D2, the print medium P1 enters the branching path CP4 branching from the reversing path CP3. The print medium P1 that has entered the branching path CP4 is reconveyed to the main path CP2 at the merging point G2. That is, a reversing path (from the branching point D1 to the merging point G2) different from the reversing path CP3 (from the branching point D1 to the merging point G1) is formed by the portion of the reversing path CP3 from the branching point D1 to the branching point D2 and the branching path CP4 (from the branching point D2 to the merging point G2). The section formed by the portion of the reversing path CP3 from the branching point D1 to the branching point D2 and the branching path CP4 will be referred to as a branching reversing section SC1 hereinafter.

(Path Length of Conveyance Path)

In this embodiment, a path length L1 of the reversing path CP3 is formed to be longer than a section length L2 of the branching reversing section SC1. That is, in the printing apparatus 1, a plurality of reversing paths having different path lengths are formed. Hence, since the reversing path can be selected in accordance with the conveyance-direction length of the print medium P to be printed, double-sided printing can efficiently be executed.

More specifically, the path length L1 is set to be longer than a length LP1 (for example, the vertical length of the A4 size) of a print medium PL that is largest in the conveyance direction among print media for which the printing apparatus 1 can execute double-sided printing. That is, the printing apparatus is configured to allow the print medium having the length LP1 to stay on the reversing path CP3. Hence, after printing on the first surface of the first print medium P, printing can be performed on the first surface of the second print medium P during the time in which the first print medium P is conveyed to the reversing path CP3 and stays there.

On the other hand, the section length L2 is set to be shorter than the length LP1 and longer than a length LP2 (for example, the vertical length of the A5 size) of a print medium PS that is smallest in the conveyance direction among print media for which the printing apparatus 1 can execute double-sided printing. That is, the print medium PS having the length LP2 can stay in the branching reversing section SC1. Since the conveyance distance at the time of reversing can be made short as compared to a case where the print medium PS small in the conveyance direction is reversed by the reversing path CP3, the efficiency of double-sided printing can be improved.

Note that the path length L1 and the section length L2 can appropriately be set. For example, if the printing apparatus 1 can perform double-sided printing for print media of three sizes, which have different lengths in the conveyance direction, the path length L1 may be set to a length with which the print medium of the largest size can stay, and the section length L2 may be set to a length with which the print medium of the second largest size in the conveyance direction can stay.

Also, in this embodiment, the reversing path CP3 and the branching reversing section SC1, whose lengths are different from each other, are formed as paths to reverse the print medium P. However, three or more paths having lengths different from each other may be formed as paths to reverse the print medium P. For example, if the conveyance path length of the reversing path CP3 is increased to the rear side of the printing apparatus 1 (the −Y direction in the drawings) without changing the positional relationship on the downstream side of the main conveyance roller 31, the maximum size A3 can easily be handled. At this time, for example, three merging portions to the main path CP2 can be provided, and three reversing paths can be set to path lengths suitable for print media of the A5, A4, and A3 sizes.

(Operation Modes of Switching Unit 70)

FIG. 5 is a view for explaining the operation modes of the switching unit in the printing operation. In this embodiment, each of the flapper 71 of the conveyance path switching unit 70A and the flapper 73 of the conveyance path switching unit 70B can be switched to two positions. That is, the switching unit can operate in four operation modes discriminated by the arrangement of the flapper 71 and the flapper 73.

A first mode is a mode in which the flapper 71 is located at the "first position", and the flapper 73 is located at the "third position". In the first mode, since the print medium P is made to pass through the branching point D1 along the main path CP2 by the flapper 71, the print medium P can be guided to the reversing/discharge region of the main path CP2. Also, in this embodiment, the "first position" of the flapper 71 and the "third position" of the flapper 73 are the initial positions of the flappers. That is, the operations of the printing apparatus 1 when executing the first mode are an initial state, discharge of the print medium PL having the largest size for which double-sided printing is possible, and printing on the first surface. Note that in this operation mode, since passing of the print medium P through the flapper 73 is not assumed, the flapper 73 is located at the "third position" as the initial position.

A second mode is a mode in which the flapper 71 is located at the "second position", and the flapper 73 is located at the "third position". In the second mode, the print medium P in the reversing/discharge region of the main path CP2 is guided by the flapper 71 from the branching point D2 to the reversing path CP3. Also, the print medium P guided to the reversing path CP3 is made to pass through the branching point D2 along the reversing path CP3 by the flapper 73. Hence, the print medium P is reconveyed from the merging point G1 to the upstream side of the printing position 10*a* on the main path CP2. The operation of the printing apparatus 1 when executing the second mode is reversing conveyance of the print medium PL having the largest size for which double-sided printing is possible.

A third mode is a mode in which the flapper 71 is located at the "second position", and the flapper 73 is located at the "fourth position". In the third mode, the print medium P in the reversing/discharge region of the main path CP2 is guided by the flapper 71 from the branching point D2 to the reversing path CP3. Also, the print medium P guided to the reversing path CP3 is guided from the branching point D2 to the branching path CP4 by the flapper 73. Hence, the print medium P is reconveyed from the merging point G2 to the upstream side of the printing position 10*a* on the main path CP2. The operation of the printing apparatus 1 when executing the third mode is reversing conveyance of the print medium PS having the smallest size for which double-sided printing is possible.

A fourth mode is a mode in which the flapper 71 is located at the "first position", and the flapper 73 is located at the "fourth position". In the fourth mode, the print medium P in the reversing/discharge region of the main path CP2 is guided by the flapper 71 from the branching point D2 to the reversing path CP3. Also, the print medium P guided to the reversing path CP3 is guided from the branching point D2 to the branching path CP4 by the flapper 73. The operations of the printing apparatus 1 when executing the fourth mode are discharge of the print medium PS having the smallest size for which double-sided printing is possible and printing on the first surface. Note that although the "fourth mode" can be replaced with the "first mode", when the "fourth mode" is provided, the switching time of the flapper 73 can be shortened in double-sided printing of the print medium PS.

Detailed Example of Double-Sided Printing Operation

Switching of the operation mode of the switching unit 70 in the double-sided printing operation of the print medium P will be described in detail.

First, the double-sided printing operation of the print medium PL having the largest size for which double-sided printing is possible will be described. A preceding print medium will be referred to as a print medium PL1 and a succeeding print medium as a print medium PL2 hereinafter.

First, after the print medium PL1 is fed from the sheet stacking unit 20A to the paper feed path CP1, the switching unit 70 is in the first mode when the printing unit 10 is performing printing on the first surface (obverse surface). After printing on the first surface, when the print medium PL1 is further conveyed, and the trailing edge of the print medium PL1 is detected by the sensor 37, the switching unit 70 is switched to the second mode. After that, the print medium PL1 is conveyed to the reversing path CP3 by the reversing roller 38.

When the print medium PL1 is conveyed to the reversing path CP3, printing on the first surface of the succeeding print medium PL2 is performed. That is, in a state in which the succeeding print medium PL1 is staying on the reversing path CP3, the switching unit 70 is switched to the first mode. Then, printing is performed on the first surface of the print medium PL2. After that, when the print medium PL2 is further conveyed, and the trailing edge of the print medium PL2 is detected by the sensor 37, the switching unit 70 is switched to the second mode. After that, the print medium PL2 is conveyed to the reversing path CP3 by the reversing roller 38. On the other hand, to enable execution of printing on the second surface of the print medium PL1 next to the printing on the first surface of the print medium PL2, the print medium PL1 is reconveyed from the reversing path CP3 to the main path CP2 via the merging point G1. For example, when the print medium PL1 is reconveyed to the paper feed path CP1, and its leading edge is detected by the sensor 34, processing waits until a state in which printing on the second surface is possible (a state in which the mode is switched from the second mode to the first mode) is obtained.

When the print medium PL2 is conveyed to the reversing path CP3, the switching unit 70 is switched from the second mode to the first mode. Then, printing is performed on the second surface of the print medium PL1, and the print medium PL1 is discharged from the main path CP2.

By this operation, double-sided printing can be performed in the order of the first surface of the print medium PL1, the first surface of the print medium PL2, the second surface of the print medium PL1, the second surface of the print medium PL2, the first surface of a print medium PL3, . . . . It is therefore possible to efficiently perform double-sided printing as compared to a case where double-sided printing is sequentially performed for each sheet.

Double-sided printing can also be performed for the print medium PS having the smallest size for which double-sided printing is possible by a similar operation to that for the print medium PL. In the double-sided printing operation of the print medium PS, however, the fourth mode is executed in place of the first mode in the double-sided printing of the print medium PL, and the third mode is executed in place of the second mode.

<Control Configuration>

Figure 6:
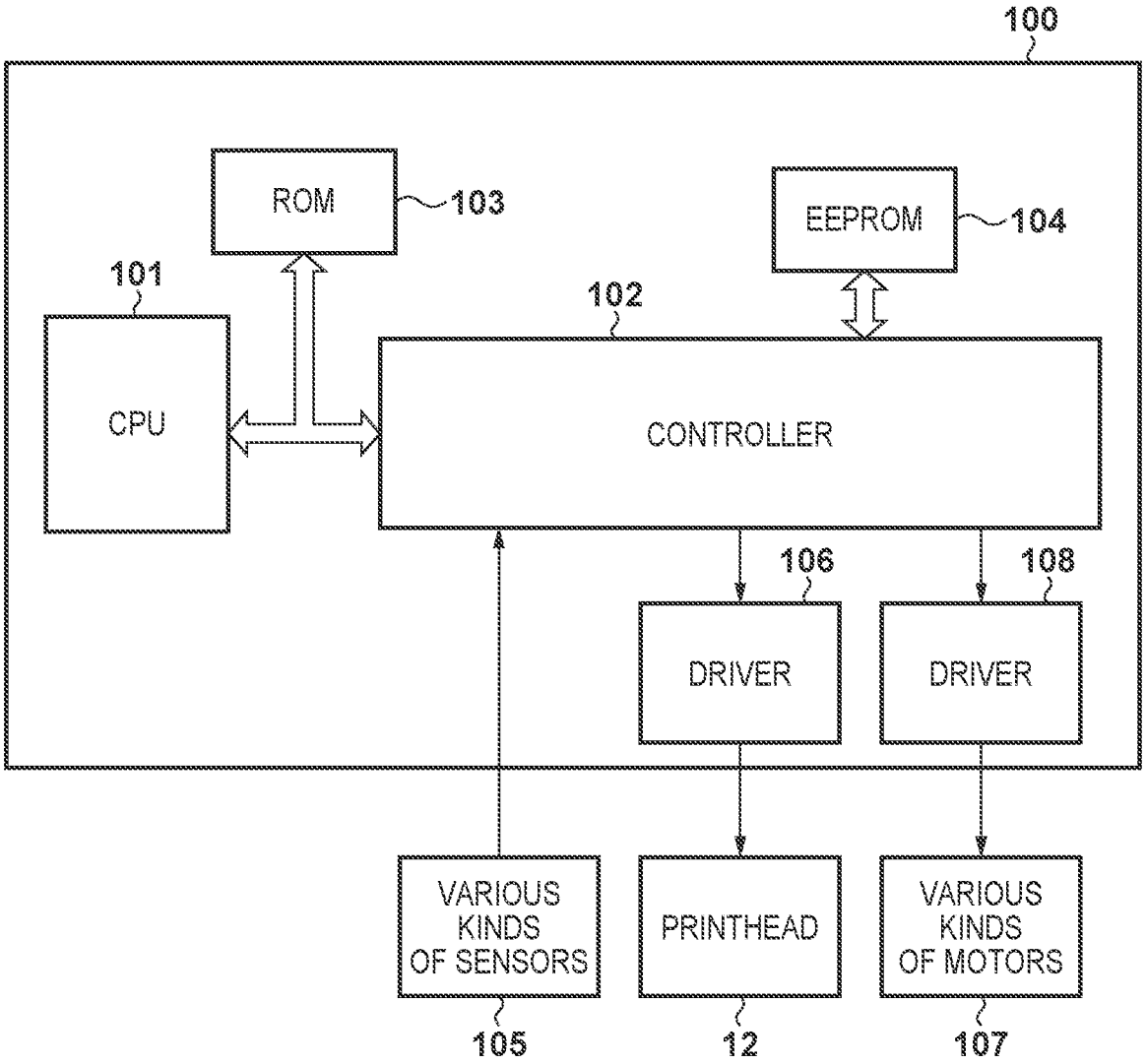
FIG. 6 is a block diagram showing the configuration of the control system of the printing apparatus.

FIG. 6 is a block diagram showing the configuration of the control system of the printing apparatus 1. The control circuit 100 is a circuit that controls the operation of each mechanism unit of the printing apparatus 1. The Central Processing Unit (CPU) 101 controls the entire printing apparatus 1. A controller 102 assists the CPU 101 and performs drive control of various kinds of motors 107 and the printhead 12 in accordance with the detection results of various kinds of sensors 105. Various kinds of data and the control program of the CPU 101 are stored in a Read Only Memory (ROM) 103. Various kinds of data are stored in an Electrically Erasable Programmable Read-Only Memory (EEPROM) 104. Note that another storage device may be employed in place of the ROM 103 and the EEPROM 104.

Also, the control circuit 100 is configured to receive a print job from an external apparatus such as a personal computer via a communication interface (not shown). For example, the control circuit 100 executes switching control of the switching unit 70 based on print job information (including, for example, image data, a print medium size, and the number of sheets to be printed) received from the external apparatus.

A driver 108 drives the various kinds of motors 107. The various kinds of motors 107 include, for example, the above-described driving sources 25, 32, 58, 13, 71*a*, and 73. A driver 106 drives the printhead 12. The various kinds of sensors 105 include a sensor that detects the position of the carriage 11, and sensors that are disposed in the conveyance path of the print medium and detect the leading and trailing edges of the print medium, more specifically, the sensors 52, 34, 37, and 59.

Example of Control (Paper Feed Sequence)

Figure 7A:
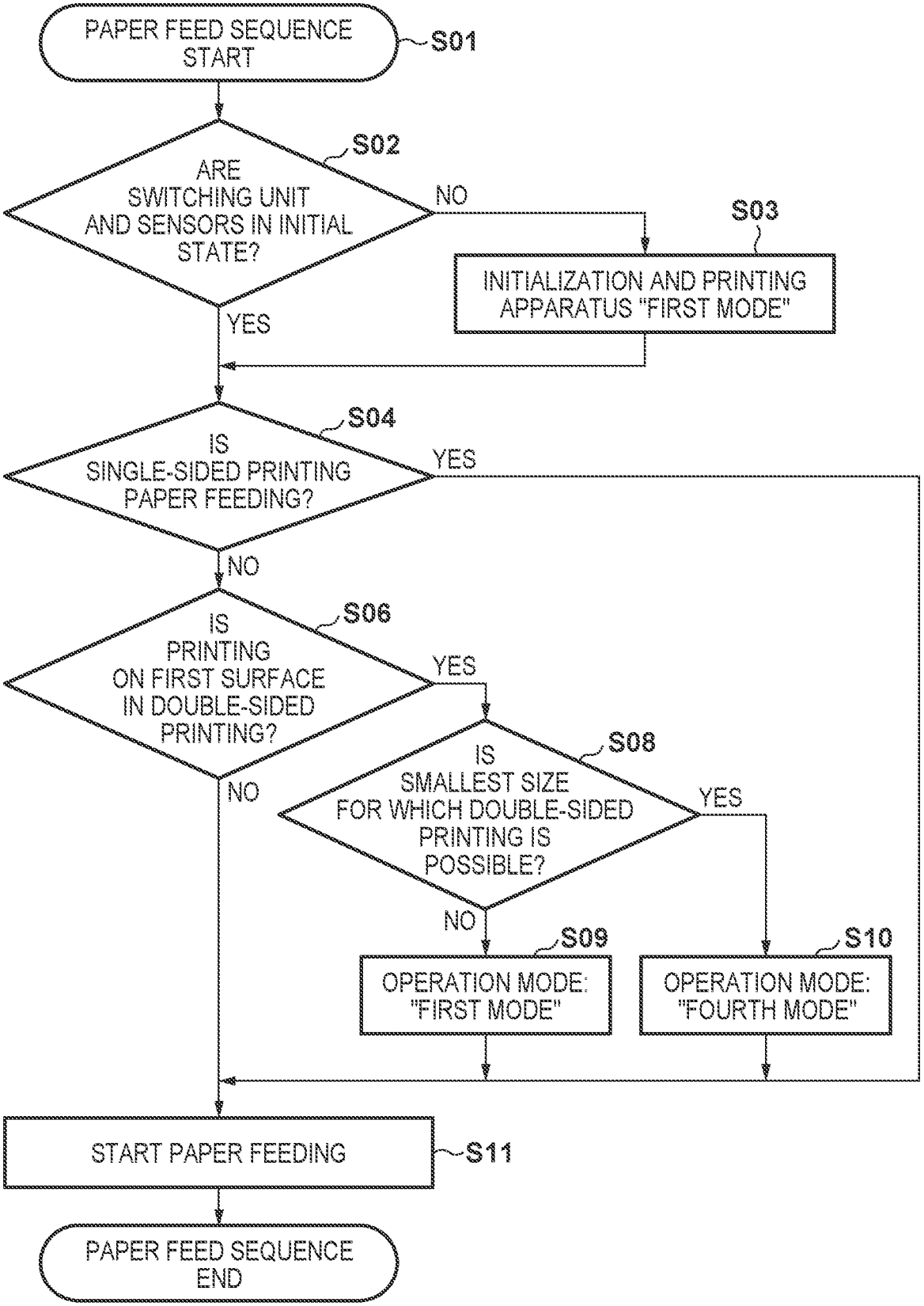
FIG. 7A is a flowchart showing the paper feed sequence of the printing apparatus.

FIG. 7A is a flowchart showing the paper feed sequence of the printing apparatus 1. The processing of this flowchart is implemented by, for example, the CPU 101 reading out a program stored in the ROM 103 and executing it. Note that here, the paper feed sequence indicates a sequence for feeding a print medium stacked on the sheet stacking unit 20A to the printing position 10*a* by the printing unit 10. In addition, feeding of the print medium to the printing position 10*a* includes feeding of the print medium and feeding of the print medium that is staying in the reversing path CP3 or the branching reversing section SC1 after the end of printing on the first surface.

In step S02, the CPU 101 confirms whether the switching unit 70 and the various kinds of sensors 105 are in the initial state. If these are in the initial state, the CPU 101 advances to step S04; otherwise, the CPU 101 advances to step S03.

In step S03, the CPU 101 initializes the states of the switching unit 70 and the various kinds of sensors 105, sets the mode of the switching unit 70 to the above-described "first mode", and advances to step S04.

In step S04, the CPU 101 confirms whether the current paper feeding is single-sided print paper feeding. If the current paper feeding is single-sided print paper feeding, the CPU 101 advances to step S11 to start paper feeding. That is, in single-sided printing, the switching unit 70 always operates in the "first mode".

In step S06, the CPU 101 determines whether the paper feeding to be executed at the current time is paper feeding for printing on the first surface (obverse surface) in double-sided printing. If it is paper feeding for first surface printing of double-sided printing, the process advances to step S08. On the other hand, otherwise (for example, if it is paper feeding for second surface printing), the process advances to step S11.

In step S08, the CPU 101 determines whether the size of the print medium designated in the print job is the smallest size for which double-sided printing is possible. If the size of the print medium is the smallest size for which double-sided printing is possible, the CPU 101 advances to step S10; otherwise, the CPU 101 advances to step S09.

If the process advances from step S08 to step S09, the CPU 101 sets the operation mode of the switching unit 70 to the "first mode". Note that in actuality, since the operation mode is set to the "first mode" in step S02, the "first mode"

is maintained, and the switching operation is not executed. After that, the CPU 101 advances to step S11.

If the process advances from step S08 to step S10, the CPU 101 sets the operation mode of the switching unit 70 to the "fourth mode". After that, the CPU 101 advances to step S11. That is, if the size of the print medium is the smallest size for which double-sided printing is possible, the operation mode of the switching unit 70 is set to the "fourth mode".

In step S11, the CPU 101 starts feeding the print medium. By this processing, it is possible to set the operation mode of the switching unit 70 to an appropriate state in accordance with the print mode (single-sided printing or double-sided printing) and the print medium size and start paper feeding.

(Reversing Sequence)

Figure 7B:
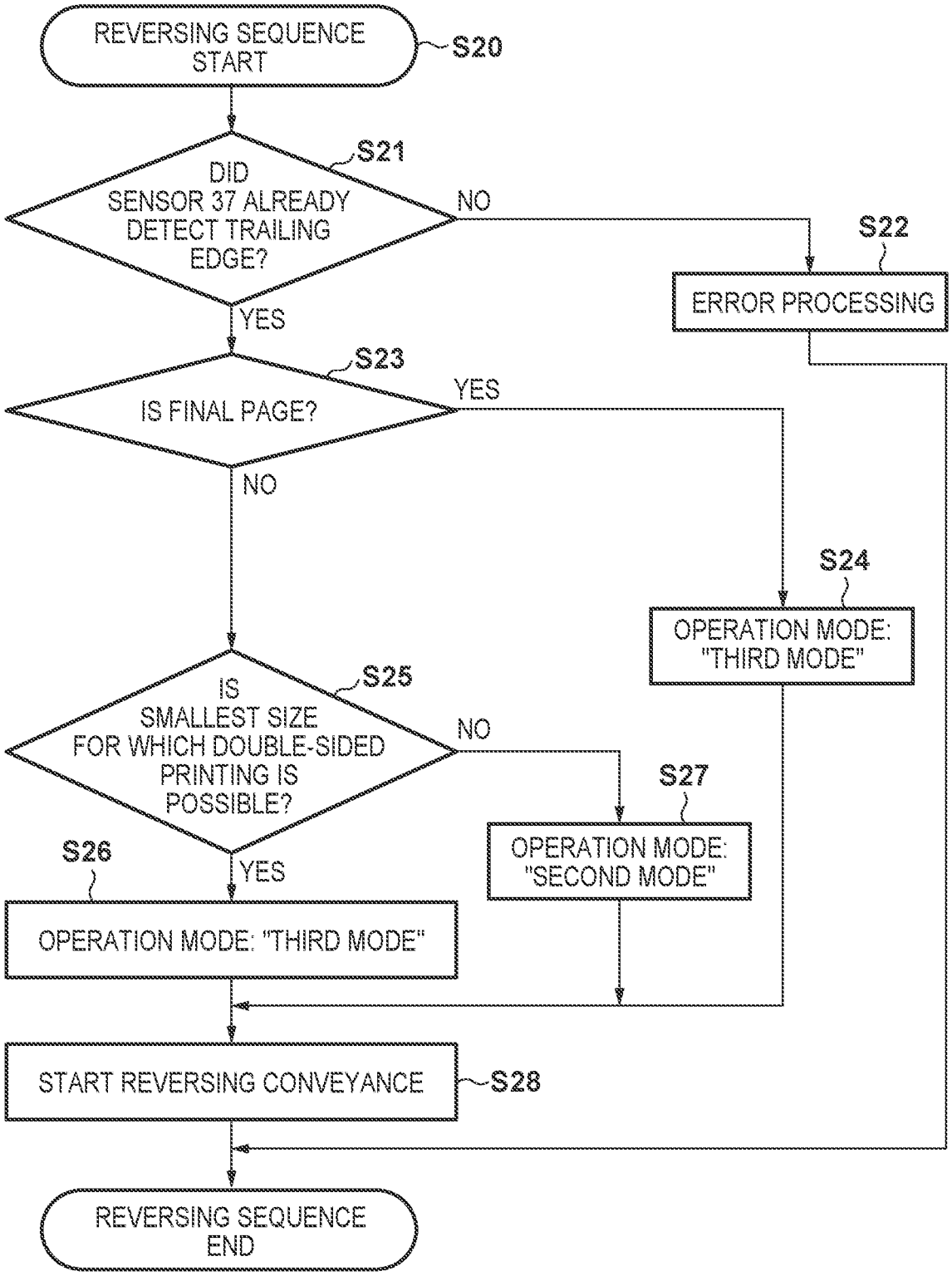
FIG. 7B is a flowchart showing the reversing sequence of the printing apparatus.

FIG. 7B is a flowchart showing the reversing sequence of the printing apparatus 1. The reversing sequence is a sequence for reversing the obverse and reverse surfaces of the print medium P with the first surface printed in double-sided printing. This flowchart is executed when, for example, printing on the first surface of the print medium P by the printing unit 10 is ended in double-sided printing (step S20). Note that if printing on the second surface of the print medium P is ended, the print medium is discharged from the printing apparatus 1 without performing this sequence.

In step S21, the CPU 101 confirms whether the trailing edge of the print medium P is already detected by the sensor 37 (see FIG. 3). If the trailing edge is already detected, the CPU 101 advances to step S23; otherwise, the CPU 101 advances to step S22. If the trailing edge of the print medium P is not detected by the sensor 37 (NO in step S21), it is considered that the print medium P is not conveyed to the sensor 37, or the print medium P is conveyed but cannot pass through the sensor 37. In this case, it can be assumed that jam has occurred, or the print medium size designated in the print job and the size of the actually fed print medium are different. Hence, in step S22, the CPU 101 performs error processing. For example, the CPU 101 interrupts the reversing sequence, and displays an error message on the display device 4 of the printing apparatus 1 or transmits a notification representing that an error has occurred to the external apparatus that has transmitted the print job.

In step S23, the CPU 101 confirms whether the print medium whose trailing edge is detected is the final page. If the print medium is the final page, the CPU 101 advances to step S24; otherwise, the CPU 101 advances to step S25.

In step S24, the CPU 101 sets the operation mode of the switching unit 70 to the "third mode". After that, the CPU 101 advances to step S28 to start reversing conveyance. That is, if the target print medium is the final page, the operation mode of the switching unit 70 is set to the "third mode", thereby shortening the reversing time. Even if the target print medium is not the final page, and the succeeding print medium is not in the paper feeding enable state, the reversing time can be shortened by setting the operation mode of the switching unit 70 to the "third mode".

If the process advances from step S23 to step S25, the CPU 101 determines whether the size of the preceding print medium is the smallest size for which double-sided printing is possible. Upon determining that the preceding print medium has the smallest size for which double-sided printing is possible, the CPU 101 advances to step S26 to set the operation mode of the switching unit 70 to the "third mode" and then advances to step S28 to start reversing conveyance. On the other hand, upon determining that the preceding print medium does not have the smallest size for which double-sided printing is possible, the CPU 101 advances to step S27 to set the operation mode of the switching unit 70 to the "second mode" and then advances to step S28 to start reversing conveyance. That is, the CPU 101 selects the reversing path in accordance with the size of the print medium in the conveyance direction, and switches the position of the flapper 73 of the switching unit 70 in accordance with the selection result.

According to the above-described sequence, if the length of the print medium in the conveyance direction is short (for example, if the size is the smallest size for which double-sided printing is possible), the obverse and reverse surfaces of the print medium can be reversed using the reversing path with the short path length, and therefore, double-sided printing can more efficiently be executed. Even if the length of the print medium in the conveyance direction is long, if the print medium is the final page, the obverse and reverse surfaces of the print medium are reversed using the reversing path with the short path length, and therefore, double-sided printing can more efficiently be executed.

Also, in this embodiment, the branching path CP4 branching from the reversing path CP3 forms the branching reversing section SC1 having a path length different from that of the reversing path CP3. In other words, the plurality of reversing paths formed in the printing apparatus 1 partially have a common part. This can make the printing apparatus 1 compact as compared to a case where a plurality of reversing paths are independently provided.

Second Embodiment

Figure 8:
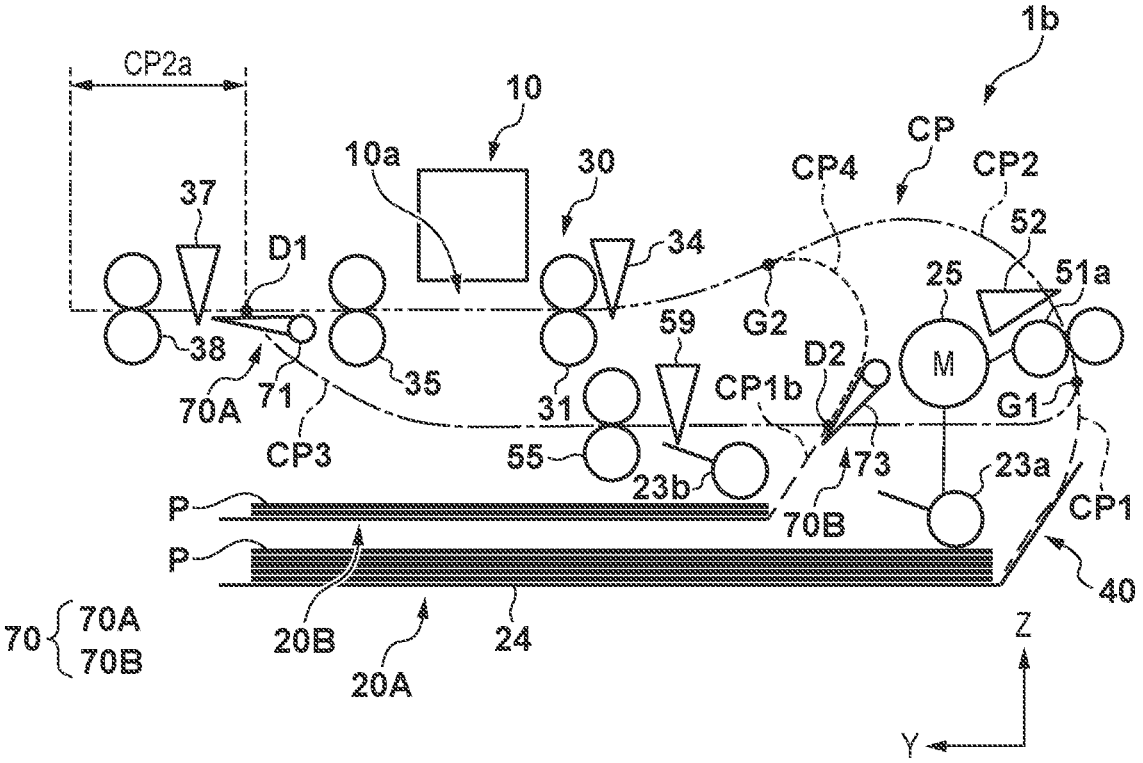
FIG. 8 is a schematic view for explaining the internal configuration of a printing apparatus according to an embodiment.

FIG. 8 is a schematic view for explaining the internal configuration of a printing apparatus 1*b* according to an embodiment. The printing apparatus 1*b* is different from the printing apparatus 1 according to the first embodiment in that it includes a sheet stacking unit 20B corresponding to a print medium PS having the smallest size for which double-sided printing is possible. Hereinafter, the same reference numerals as in the printing apparatus 1 according to the first embodiment denote the same parts, and a description thereof will be omitted.

The sheet stacking unit 20B includes a paper feed cassette 24 that stacks the print medium PS, and a paper feed roller 23*b* that feeds the print medium PS stacked in the paper feed cassette 24. The paper feed roller 23*b* can have a similar configuration to a paper feed roller 23*a* of a sheet stacking unit 20A. The print medium PS stacked in the paper feed cassette 24 of the sheet stacking unit 20B is fed to a paper feed path CP1*b* by the paper feed roller 23*b* and conveyed to a branching path CP4 via a branching point D2. At this time, a flapper 73 of a conveyance path switching unit 70B is located at a "fourth position". That is, the flapper 73 forms a path that introduces, to the branching path CP4, the print medium that has entered from a main path CP2 to a reversing path CP3, and also forms a path that introduces the print medium from the paper feed path CP1*b* to the branching path CP4.

In this embodiment, the conveyance path length from the sheet stacking unit 20B to a printing unit 10 is shorter than the conveyance path length from the sheet stacking unit 20A to the printing unit 10. Hence, when performing double-sided printing for the print medium PS with the smallest size, the time until execution of printing on the first surface or the paper feeding time in single-sided printing can be shortened. In addition, the flapper 73 has both the function of guiding the print medium PS from the reversing path CP3 to the branching path CP4 and the function of guiding the print medium PS from the sheet stacking unit 20B to the branching path CP4.

Third Embodiment

Figure 9:
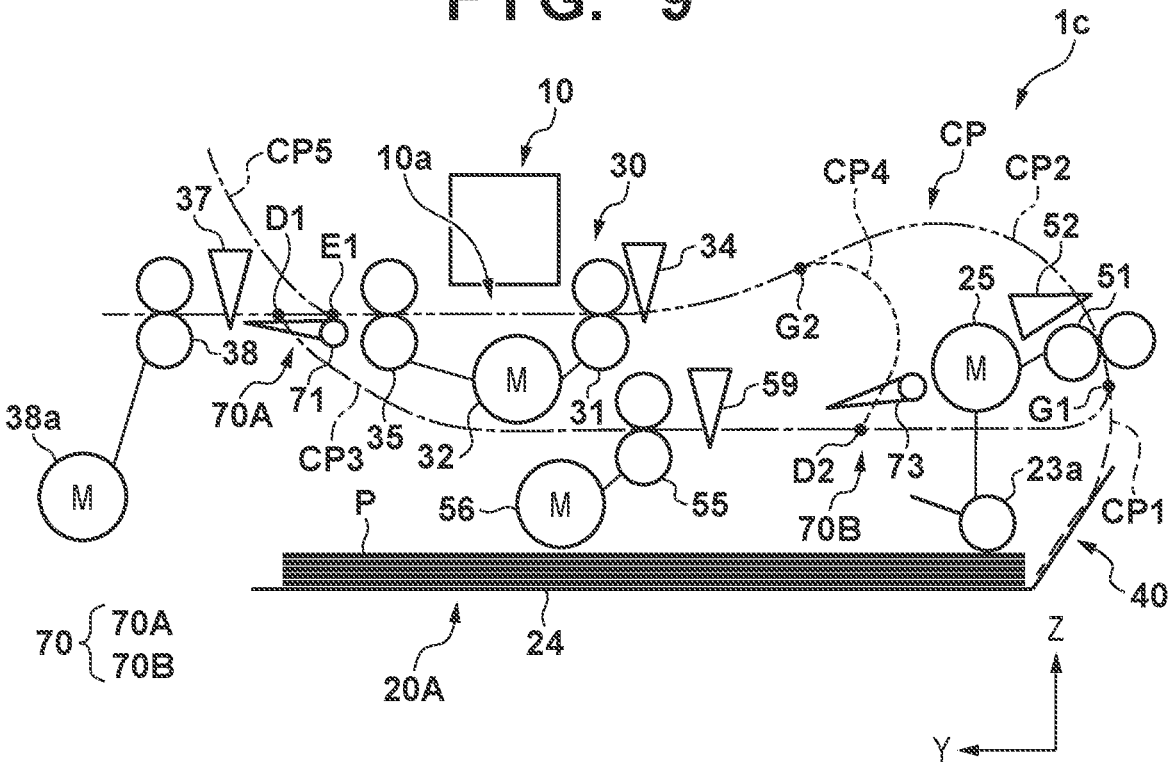
FIG. 9 is a schematic view for explaining the internal configuration of a printing apparatus according to an embodiment.

FIG. 9 is a schematic view for explaining the internal configuration of a printing apparatus 1*c* according to an embodiment. The printing apparatus 1*c* is different from the printing apparatus 1 according to the first embodiment in that the discharge path of a print medium branches from a main path CP2. Hereinafter, the same reference numerals as in the printing apparatus 1 according to the first embodiment denote the same parts, and a description thereof will be omitted.

In this embodiment, a discharge path CP5 branches from a branching point E1 between a branching point D1 and a discharge roller 35 on the downstream side of a printing position 10*a* on a main path CP2. Note that here, the main path CP2 on the downstream side of the branching point E1 extends in the horizontal direction, and the conveyance path CP5 extends upward from the branching point E1. The arrangement of these can appropriately be changed.

Figure 10A:
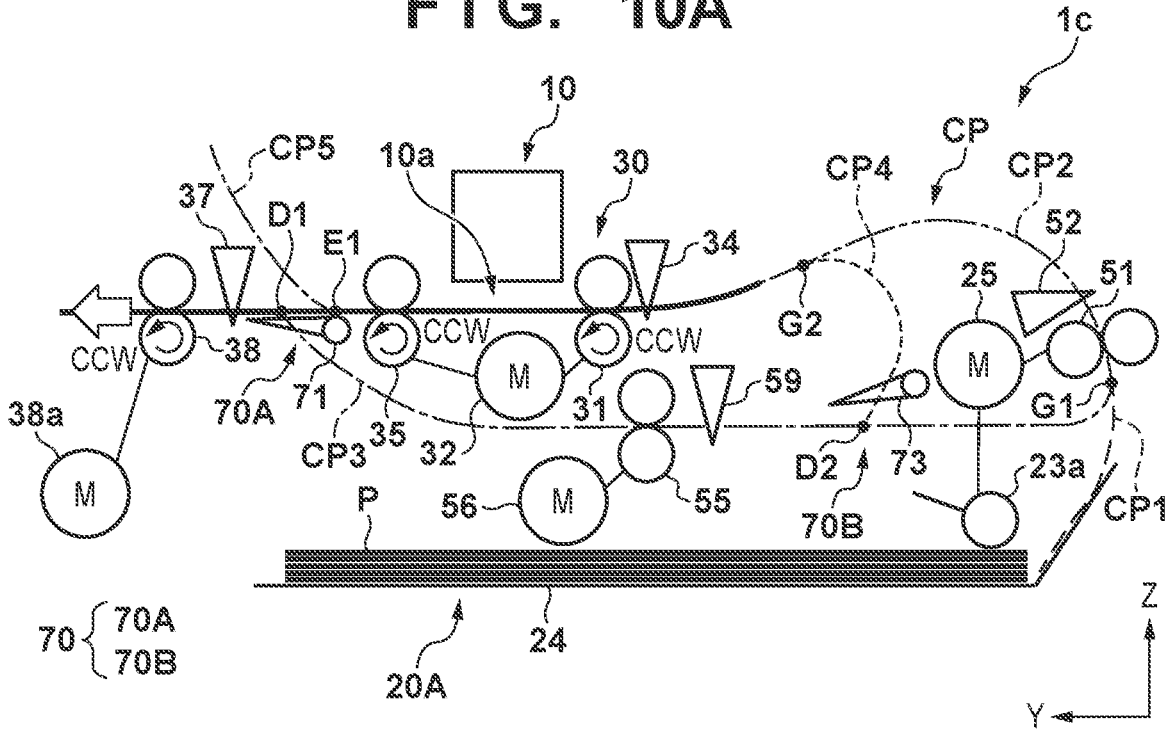
FIGS. 10A and 10B are schematic views for explaining the internal configuration of a printing apparatus according to an embodiment.
Figure 10B:
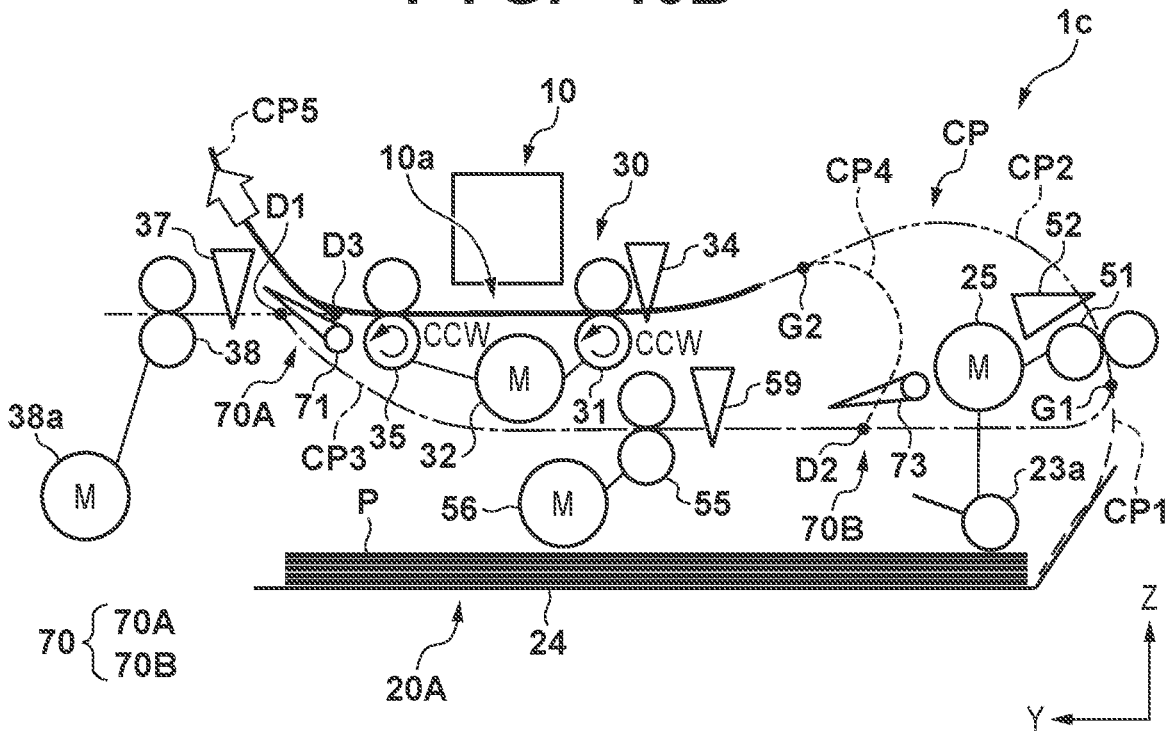

In this embodiment, since the path for reversing a print medium P (the main path CP2 on the downstream side of a branching point D2) and the conveyance path CP5 are separated, the functions of a flapper 71 at two positions are different from those in the first embodiment. This will be described below with reference to FIGS. 10A and 10B.

A "first mode" that is an operation mode of a switching unit 70 in the first embodiment is a mode selected in an initial state, at the time of printing on the first surface of a print medium PL having the largest size for which double-sided printing is possible, and at the time of discharge. On the other hand, in this embodiment, the flapper 71 guides the print medium PL to the path for reversing (the main path CP2 on the downstream side of the branching point D2) at a "first position" (FIG. 10A), and guides the print medium PL to the conveyance path CP5 at a "second position". Hence, as shown in FIG. 11, the "first mode" is a mode selected only in the initial state and at the time of printing on the first surface of the print medium PL having the largest size for which double-sided printing is possible. When reversing and discharging the print medium PL having the largest size for which double-sided printing is possible, a "second mode" is selected. For a print medium PS having the smallest size for which double-sided printing is possible as well, a "third mode" is selected at the time of discharge.

Fourth Embodiment

Figure 12:
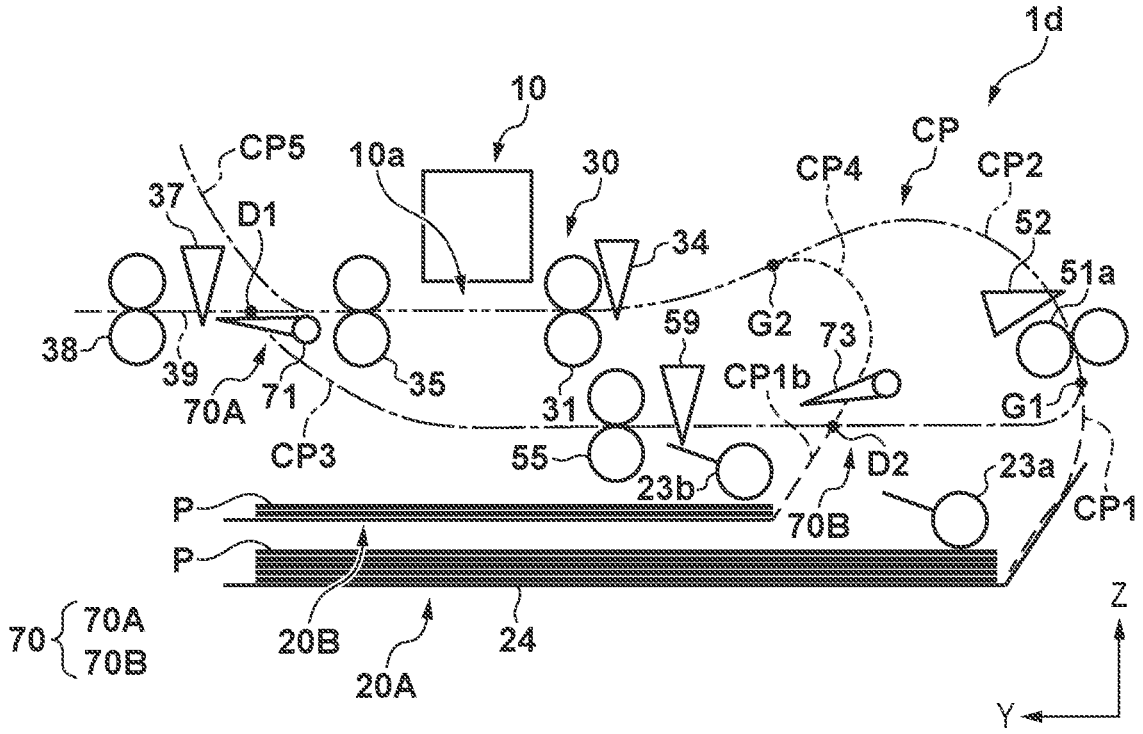
FIG. 12 is a schematic view for explaining the internal configuration of a printing apparatus according to an embodiment.

FIG. 12 is a schematic view for explaining the internal configuration of a printing apparatus 1*d* according to an embodiment. In this embodiment, the configuration of the second embodiment in which a sheet stacking unit 20B is added and the configuration of the third embodiment in which a conveyance path CP5 branches from a main path CP2 are combined. Thus, the configurations of the embodiments can appropriately be combined.

As described above, according to the above-described embodiment, in the printing apparatus capable of performing double-sided printing on the first surface and the second surface of a print medium, it is possible to improve double-sided productivity without making the printing apparatus bulky regardless of the size (conveyance-direction length) of the corresponding print medium.

Other Embodiments

In the above-described embodiments, the reversing path is selected based on the length of the print medium P in the conveyance direction. However, the conveyance path may be selected based on another condition. For example, the CPU 101 may select, based on the type of the print medium P, whether to reverse the print medium P by the reversing path CP3 or reverse the print medium P by the branching reversing section SC1. Furthermore, the bending of the branching reversing section SC1 is sometimes tight because its path length is shorter than that of the reversing path CP3. Hence, the reversing path CP3 may be selected for the print medium P that is relatively difficult to bend. More specifically, if the print medium P is plain paper, the branching reversing section SC1 may be selected, and if the print medium P is not plain paper, the reversing path CP3 may be selected. Also, if the basis weight of the print medium P is equal to or larger than a threshold, the CPU 101 may select the reversing path CP3, and if the basis weight is smaller than the threshold, the CPU 101 may select the branching reversing section SC1. When the reversing path is selected in accordance with the type of the print medium P, it is possible to suppress the occurrence of j am caused by, for example, forcibly bending the print medium P that is difficult to bend.

In addition, the CPU 101 may select a path based on each of the condition of the length of the print medium P in the conveyance direction and another condition (for example, the above-described condition concerning the type of the print medium P). As another condition, the print duty of image data received as a print job can be used. If the print duty in printing for the succeeding print medium P is equal to or larger than a threshold, the reversing path CP3 may be selected. That is, if the print duty is relatively large, a relatively long time is needed for the printing operation, and therefore, it may be unnecessary to shorten the reverting time using the branching reversing section SC1. Hence, in this case, the main path CP2 may be selected. If different results of path selection are obtained, a path selected by path selection based on a condition other than the condition of the length in the conveyance direction may finally be selected. For example, for the print medium P that is not plain paper or the print medium P whose basis weight is equal to or larger than a threshold, the reversing path CP3 may be selected regardless of the length of the print medium P in the conveyance direction. This makes it possible to efficiently execute the double-sided printing operation while suppressing the occurrence of jam.

Embodiment(s) of the present disclosure can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-087099, filed May 27, 2022, which is hereby incorporated by reference herein in its entirety.

What is claimed is:

1. A printing apparatus comprising:

a printing unit configured to perform printing at a printing position on a print medium conveyed in a conveyance direction;

a first conveyance path configured to cause the print medium to pass through the printing position of the printing unit;

a first conveyance roller provided on the upstream side of the printing position on the first conveyance path and configured to convey a first print medium to the printing position;

a second conveyance path configured to branch from the first conveyance path at a first branching point on a downstream side of the printing position in the conveyance direction and merges into the first conveyance path on an upstream side of the printing position;

a second conveyance roller provided on a downstream side of the first branching point on the first conveyance path and capable of changing an advancing direction of the first print medium, a first surface of which has been printed by the printing unit, to a reverse direction that is reverse to a direction in a case in which a second surface, which is opposite to the first surface, of the first print medium is to be printed by the printing unit;

a first flapper provided between the printing position and the second conveyance roller and capable of switching, at the first branching point, an entry destination of the first print medium conveyed in the reverse direction by the second conveyance roller to the second conveyance path; and a third conveyance path configured to branch from a second branching point on the second conveyance path and merge into the first conveyance path on the upstream side of the printing position.

2. The printing apparatus according to claim 1, wherein a print medium whose length in the conveyance direction is a first length is capable of staying on the second conveyance path, wherein a print medium whose length in the conveyance direction is a second length is capable of staying in a section formed by a portion of the second conveyance path from the first branching point to the second branching point and the third conveyance path, and wherein the first length is longer than a length of the section.

3. The printing apparatus according to claim 1, wherein a discharge roller configured to discharge the first print medium is provided on a downstream side of the first conveyance roller on the first conveyance path.

4. The printing apparatus according to claim 1, further comprising:

a first stacking unit configured to stack the print medium whose length in the conveyance direction is the first length;

a first feeding unit configured to feed the print medium stacked on the first stacking unit to the first conveyance path;

a second stacking unit configured to stack the print medium whose length in the conveyance direction is the second length; and a second feeding unit configured to feed the print medium stacked on the second stacking unit to the first conveyance path via the third conveyance path.

5. The printing apparatus according to claim 1, wherein the first print medium is discharged from a discharge path branching from a third branching point between the printing position and the first branching point.

6. The printing apparatus according to claim 5, wherein the first flapper is switchable between a first position at which the first print medium can pass through the first branching point along the first conveyance path and a second position at which the first print medium conveyed in the reverse direction by the second conveyance roller can enter from the first branching point to the second conveyance path, and wherein, if the first flapper is located at the second position, and the first print medium is conveyed to the third branching point, the first print medium is discharged via the discharge path.

7. The printing apparatus according to claim 1, further comprising:

a second flapper capable of switching, at the second branching point, an entry destination of the print medium to the third conveyance path; and a control circuit configured to perform path selection when reversing the print medium, wherein the control circuit is configured to control the second flapper based on a result of the path selection.

8. The printing apparatus according to claim 7, wherein the control circuit unit performs the path selection based on a conveyance-direction length of a print medium whose obverse and reverse surfaces are to be reversed.

9. The printing apparatus according to claim 7, wherein, among print media whose obverse and reverse surfaces are to be reversed, the control circuit performs the path selection based on a remaining number of the print media whose obverse and reverse surfaces are to be reversed.

10. The printing apparatus according to claim 7, wherein the control circuit performs the path selection based on a type of a print medium whose obverse and reverse surfaces are to be reversed.

11. The printing apparatus according to claim 7, wherein the control circuit performs first path selection based on a first condition concerning a conveyance-direction length of a print medium whose obverse and reverse surfaces are to be reversed, and performs second path selection based on a second condition other than the first condition of the print medium whose obverse and reverse surfaces are to be reversed, and wherein, if a selection result changes between the first path selection and the second path selection, the control circuit selects a path selected by the second path selection.

12. The printing apparatus according to claim 1, further comprising:

a stacking unit configured to stack the print medium; and a feeding unit configured to feed the print medium stacked on the stacking unit to the first conveyance path.

* * * * *